United States Patent [19]

Reichardt et al.

[11] 4,421,708

[45] Dec. 20, 1983

[54] PROCESS FOR THE PRODUCTION OF HIGH-STRENGTH FILAMENTS FROM DRY-SPUN POLYACRYLONITRILE

[75] Inventors: Manfred Reichardt, Dormagen; Christian Pieper, Neuss; Alfred Nogaj, Dormagen; Surinder S. Sandhu, Dormagen; Eckhard Gärtner, Dormagen, all of Fed. Rep. of Germany

[73] Assignee: Bayer Aktiengesellschaft, Leverkusen, Fed. Rep. of Germany

[21] Appl. No.: 345,845

[22] Filed: Feb. 4, 1982

[30] Foreign Application Priority Data

Feb. 13, 1981 [DE] Fed. Rep. of Germany ..... 3105360

[51] Int. Cl.[3] ..... D01F 7/00

[52] U.S. Cl. ..... 264/206; 264/210.7; 264/210.8; 526/341; 528/502

[58] Field of Search ..... 264/29.2, 206, 210.7, 264/210.8; 528/502; 526/341

[56] References Cited

U.S. PATENT DOCUMENTS

| | | | |
|---|---|---|---|
| 3,925,524 | 12/1975 | Kommel et al. | 264/206 |
| 4,079,122 | 3/1978 | McLoughlin et al. | 264/29.2 |
| 4,271,056 | 6/1981 | Coleman et al. | 264/206 |
| 4,285,831 | 8/1981 | Yoshida et al. | 264/29.2 |
| 4,301,107 | 11/1981 | Kreahling et al. | 264/206 |
| 4,303,607 | 12/1981 | De Maria et al. | 264/206 |

FOREIGN PATENT DOCUMENTS

| | | | |
|---|---|---|---|
| 2658916 | 7/1978 | Fed. Rep. of Germany | 264/206 |
| 45-1650 | 1/1970 | Japan | 264/206 |
| 53-111126 | 9/1978 | Japan | 264/206 |
| 53-139824 | 12/1978 | Japan | 264/206 |

*Primary Examiner*—Jay H. Woo

*Attorney, Agent, or Firm*—Sprung, Horn, Kramer & Woods

[57] ABSTRACT

High-strength filaments of dry-spun polyacrylonitrile are obtained by a process in which tension-reduced spun filaments are continuously stretched hydrothermally in one or more stages: where it involves several stages, stretching is carried out at a temperature of the stretching medium gradually increasing from stage to stage up to $\theta=\theta_n$ and, in the final (n-th) stage, to a degree of at least 50% of the maximum degree of stretching; where it is carried out in a single stage, stretching is carried out at the optimal stretching temperature $\theta_n$, after which the material is further treated in the conventional way, optionally with fixing of the stretched material to a pre-determined extent.

10 Claims, 1 Drawing Figure

PROCESS FOR THE PRODUCTION OF HIGH-STRENGTH FILAMENTS FROM DRY-SPUN POLYACRYLONITRILE

BACKGROUND OF THE INVENTION

It is known that, in the course of the primary processing thereof, the synthetic textile filaments (endless yarns, strands, tows and the like) obtainable from certain polymeric starting materials, such as polyamides, polyesters and polyacryls, are first spun from the melt or from solution and are then stretched in the presence of heat or heat and moisture to improve the textile qualities thereof. Stretching is generally followed by more or less intensive thermal or hydrothermal fixing of the filaments to bring about the reduction in the residual shrinkage thereof which is required for further applications.

For certain applications, for example for tyre cord, for marine ropes, for filter cloths, for parachute silk, for safety belts and for fiber reinforcements in plastics articles to increase the breaking strength thereof, high-tensile synthetic filaments and fibers compete with metal filaments and natural fibers.

Materials suitable for the production of high-strength filaments are polymeric materials, such as polyesters (polyethylene terephthalate) and polyamides (polyamide-6, polyamide-6,6), because tensile strengths of from 7 to 9.5 cN/dtex (from 95 to 130 daN/mm$^2$) may be obtained in the case of polyester filaments and of from 6 to 9 cN/dtex (from 70 to 100 daN/mm$^2$) in the case of polyamide-6 filaments by maximum stretching. Providing they are stretched to high levels at suitable temperatures, the filaments also have a high modulus of elasticity. Technical polyester filaments, for example, have modulus values of from 70 to 120 cN/dtex, while technical polyamide-6 filaments have modulus values of from 60 to 90 cN/dtex.

The above-mentioned applications requiring high tensile strength and modulus values are largely not applicable to polyacrylonitrile filaments (PAN-filaments) because it is only possible to obtain tensile strength values of from 3.5 to 4.0 cN/dtex and modulus values of from 30 to 50 cN/dtex.

However, it is known from Japanese Patent Application No. 53-139824 of 1978 that fibers having a maximum tensile strength of 6.5 cN/dtex may be obtained from wet-spun PAN containing at least 90% of acrylonitrile (spun from a 2000-bore spinneret according to Example 1) by stretching in hot water followed by further stretching in steam under an excess pressure of from 0.5 to 5 bars (the total stretching ratio $\gamma$ amounting to 18) and then by drying at from 105° to 125° C.

In the case of wet-spinning, the filaments are taken up at low speeds (for example 5 m/min.). The spun material is at most slightly pre-oriented and may at most be very highly stretched. Due to the different filaments structure thereof, as reflected inter alia in the filament cross-section ("bone-shaped" as opposed to the circular cross-section of wet-spun filaments) and in the distinctly higher orientation imparted during spinning, dry-spun PAN which is taken up at much higher speeds, generally of the order of from 200 to 400 m/min., cannot be as highly stretched as wet-spun material according to the Japanese Patent Application and, in addition, it has a distinctly lower tensile strength.

In addition, it is known from DE-OS No. 2,851,273 that wet-spun PAN containing at least 70%, by weight, of acrylonitrile may be processed by extruding the spinning solution through a 10-bore spinneret into an aqueous precipitation bath to form filaments, drawing the filaments from the precipitation bath in a first stretching stage, washing the drawn filaments to remove the precipitation medium and, drawing the washed filaments in water at from about 70° to 100° C. (2nd stretching stage), the total stretching ratio 65 of the 1st and 2nd spinning stages amounting to from 3 to 14. This known process is characterised in that the filaments obtained are subequently passed through an excess-pressure steam stretching zone having a vapor pressure sufficient for a temperature of from about 110° to 140° C. in which the filaments are drawn in a ratio $\gamma$ of at least about 20 to increase the total stretching ratio. The finished fibers have a high linear strength of at least 10 g/den (9 cN/dtex) and a high initial modulus of at least 120 g/den (110 cN/dtex).

Attempts have also been made to subject endless yarn of dry-spun PAN to an optimal after-treatment to obtain high tensile-strength values. Thus, according to DE-OS No. 1,939,388, individual filament tensile strengths of at most from 7.5 to 8.0 g/den $\triangleq$ from 6.6 to 7.1 cN/dtex are obtained from spun material containing from 20 to 40 individual filaments by stretching in steam (0.9 m tube; 100° C.; $\gamma_1=1.6$), washing and drying, followed by further stretching in a ratio $\gamma_2$ of 7 over a hot "shoe".

According to DE-OS No. 2,658,916, high-strength endless yarns having a final overall titre of from 20 to 145 tex may be obtained from dry-spun PAN. In this known process, the filament material (pre-stretched to a certain extent at the spinning stage) is stretched on a heating godet/heating bow combination at temperatures of the order of 145° C., after which the stretched filaments are twisted and treated with steam under pressure at 125° C. after winding into a package form. The finished yarns have tensile strengths of at least 4.7 cN/dtex and at most 5.35 cN/dtex.

SUMMARY OF THE INVENTION

Now, the present invention relates to a process by which it is possible to obtain high-tensile strength PAN filaments or fibers even from dry-spun material spun from spinnerets having a relatively large number of bores (at least 50, generally from 100 to 2000) and after-treated in the form of relatively thick tows (thickness at least 0.1 ktex, generally from 1 to 1000 ktex.). This process which is made rational by the use of dry spinning at relatively high take-up speeds in conjunction with spinnerets having a relatively large number of bores, enables high-strength filaments or fibers having tensile strengths of greater than 6 cN/dtex, generally from 7.2 to 10 cN/dtex, to be obtained at low cost.

It has surprisingly been found that the disadvantage of dry-spun material reflected in its lower stretchability and hence lower tensile strength by comparison with wet-spun material is avoided if the dry-spun material to be processed is produced substantially free from tension under suitable conditions. Two possible processes are available for this purpose. In the first process, a dry-spun material to be stretched to at least more than 8 times, preferably to more than from 12 to 30 times, its original length may be produced when it is spun at take-up speeds of from about 50 to 200 m/min and when acrylic polymers having a molecular weight of more than 170,000 (weight average) or 50,000 (number average) are used. The acrylonitrile polymer used is preferably a copolymer containing at least 50% of acrylonitrile and one or more ethylenically unsaturated monomers copolymerizable therewith.

The spun material is preferably spun at a take-up speed of from 80 to 160 m/min and the acrylic polymers preferably have a molecular weight of more than 190,000 (weight average).

It is advantageous to spin spinning solutions in which super-molecular structures in the solution characterised by reduced viscosity for the same polymer content, the same temperature and the same molecular weight are degraded by the following measures individually or collectively:

(a) tempering the spinning solution for at least 5 minutes at temperatures above 120° C.

(b) using polymer contents in the solution such that it has a dynamic viscosity at 120° C. of less than 40 Pas.

(c) introducing additives having a viscosity-reducing effect, such as LiCl.

In the second process, substantial freedom from tension and high stretchability may be imparted to dry-spun material spun at normal take-up speeds of from about 200 to 400 m/min. providing it is first converted into a filament structure optimal for subsequent stretching by hydrothermal treatment carried out in parallel or with predetermined shrinkage at temperatures $\theta=\theta_o$ with $\theta_{O,S}<\theta_O\leqq\theta_n+50°$ C. $\theta_{O,S}$ is the minimum temperature at which the spun material kept free from tension begins to shrink and $\theta_n$ is the optimal temperature of the last (n-th) stretching stage at which the highest possible quality of stretched material (maximum fiber strength and/or maximum initial modulus, minimum of visible fiber defects, such as snarls) is obtained. The temperature $\theta_o$ at which the hydrothermal treatment of the spun material is carried out is preferably $\theta_{O,S}+20°$ C.$<\theta_O<\theta_n+20°$ C.

The following combination of the two processes does of course also give a low-tension spun material characterised by excellent stretchability:

Acrylic polymers having a molecular weight of more than 170,000 (weight average) or 50,000 (number average) are used. Super-molecular structures in the spinning solutions are degraded by one or more of the methods described above under (a) to (c). The tow is produced at take-up speeds of from 200 to 400 m/min. and is converted into the tension-reduced state by hydrothermal treatment at temperatures $\theta=\theta_o$ with $\theta_{O,S}<\theta_o\leqq\theta_n+50°$ C.

According to the present invention, the low-tension spun material is continuously stretched hydrothermally in one or more stages. Where several stages are involved, stretching is carried out at a temperature of the stretching medium gradually increasing from stage to stage up to $\theta=\theta_n$ and, in the final stage, to a degree of at least 50%, preferably from 70 to 95% of the maximum degree of stretching. Where it is carried out in a single stage, stretching is carried out at the optimal temperature of the stretching medium $\theta=\theta_n$. In this connection, it has been found that there is an optimal stretching temperature for each polymer. At temperatures higher and lower than the optimal stretching temperature, the maximum strengths obtainable are lower than for the optimal stretching temperature. Tests have also shown that maximal tensile strengths are not necessarily obtained with maximal stretching. In general, the maximal tensile strengths are obtained at a stretching level some 5 to 20% below the maximal stretching level at the optimal temperature (cf. FIG. 1).

In general, suitable media for the hydrothermal pretreatment and stretching of the spun material are water, saturated steam and steam/air mixtures.

By the use of the low-tension spun material according to the present invention in conjunction with hydrothermal stretching, individual filament breaks which may arise out of weak spots and defects in the filaments are largely avoided. In addition to its surprisingly high tensile strength, the stretched tow also has surprisingly high initial modulus values of at least 90 cN/dtex, generally from 100 to 140 cN/dtex.

After stretching in accordance with the present invention, the stretched tow is already "pre-fixed" and accordingly has only a limited tendency towards shrinkage. Depending on the level required, residual shrinkage is first partly fixed in a hydrothermal relaxation stage at temperatures $\theta=\theta_r$ with $\theta_{n,s}<\theta_r\leqq\theta_n$($\theta_{n,s}$ is the minimum temperature at which the tow leaving the nth stretching stage begins to shrink), i.e. to a level of from 0 to 95%, generally from 50 to 90%, and then fully fixed in a following single- or multi-stage drying process which is carried out at increasing (in steps) temperatures $\theta=\theta_t$ with $\theta_r<\theta_t\leqq200°$ C.

In this multi-stage relaxation and drying process, the PAN-tow remains substantially free from snarls and loops, retains its high tensile strength and modulus values and is distinguished by a highly uniform quality of the individual textile fibers.

EXAMPLES

EXAMPLE 1

Figure 1:
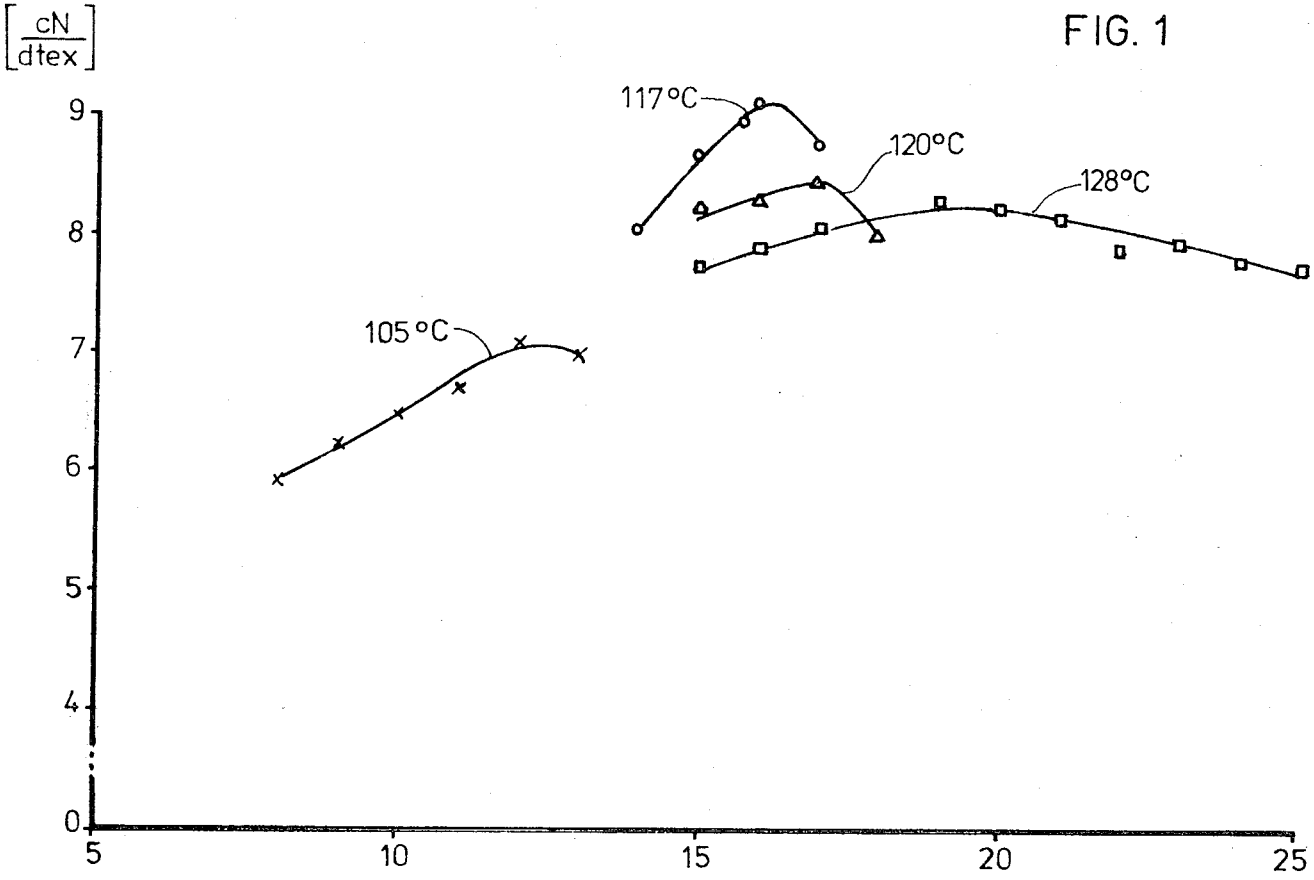
FIG. 1 is a graph of maximum tensile strength (cN/dtex) vs. maximum promoted stretching ratio for four different promoting strengthening temperatures.

Production of spun material according to the present invention suitable for processing into high-strength fibers A pure acrylonitrile polymer which had been polymerised in the conventional way and in an aqueous suspension and which had a molecular weight of 210,000 (weight average) and 76,000 (number average) was dissolved in DMF (dimethyl formamide) containing LiCl. The resulting solution consisted of 22% of polyacrylonitrile 77.5% of DMF and 0.5% of LiCl. It was spun at a throughput of 420 cc/min through a spinneret having 1050 bores 0.25 mm in diameter into a spinning duct, the jacket of which had been heated to a temperature of 200° C. Air heated to 250° C. was blown directly onto the spun filaments immediately beneath the spinneret at a rate of 40 $Nm^3/h$. The filaments were taken up from the spinning duct at a speed of 175 m/min. The spun material had a maximum stretching ratio $\gamma_{max}$ in boiling water of 11 (the "maximum stretching ratio" is to be understood to be the maximum stretchability of the spun material before reaching the breaking point). Even at this stage, the tow contained a certain number of snarls due inter alia to certain irregularities in the spun material. It had a residual solvent content of 25% and an individual-filament denier of 5.0 dtex. This spun material could even be stretched cold to 3.1 times its original length and, even in the absence of further after-treatment, showed a strength of 2.4 cN/dtex, based on the titre at break. An optimal stretching ratio $\gamma$ of 10 was adjusted for stretching in boiling water. The optimal "stretching ratio" is to be understood to be the maximum extent to which the spun material may be stretched without developing snarls (individual filament breaks). Accordingly, the optimal stretching ratio amounted to 91% of the maximum stretching ratio.

The thus-produced stretched tow had an individual filament tensile strength of 6.5 cN/dtex (based on the initial titre) and an individual filament braking elongation of 13.1%.

EXAMPLE 2

Production of spun material according to the present invention suitable for processing into high-strength fibers.

A solution of 24% of the same polymer as in Example 1, 74% of DMF and 2% of LiCl was prepared and first heated to 140° C. and then cooled to 60° C. The thus-obtained spinning solution was passed under pressure through a 96-bore spinneret (bore diameter 0.2 mm) at a rate of 79 cc/min. Air heated to 200° C. was blown onto the spun filaments at a rate of 35 $Nm^3/h$. The filaments were taken up from the spinning duct (jacket temperature 180° C.) at a speed of 100 m/min. The filaments had an individual denier of about 20 dtex. They could be stretched to a maximum of 13 times the original length thereof in boiling water. The thus-stretched filaments had a titre of 1.6 dtex, a maximum tensile strength of 7.4 cN/dtex and a maximum tensile elongation of 17%. In steam, the filaments could be stretched to at most 18 times the original length thereof at a temperature of 120° C. After this stretching the filaments had a titre of 1.0 dtex, a maximum tensile strength of 9.0 cN/dtex and a maximum tensile elongation of 12.2%. The relative loop tenacity of the filaments amounted to 15% of the titre-based strength thereof while the loop elongation thereof amounted to 50% of the maximum tensile elongation thereof. When the maximally-stretched filaments were treated with steam at 120° C. for 30 seconds, they shrank by about 8%. Thereafter, they had a titre of 1.1 dtex, a maximum tensile strength of 7.7 cN/dtex and a maximum tensile elongation of 19%. This treatment doubled the relative loop tenacity to 42% and the relative loop elongation to 60%. After this treatment, the filaments had a DMF-content of less than 1%.

EXAMPLE 3

Production of spun material according to the present invention suitable for processing into high-strength fibres and determination of the optimal stretching temperature.

A solution of 22% of a copolymer which had been polymerised from 94% of AN, 5.4% of AME and 0.6% of MAS (AN: acrylonitrile, AME: acrylic acid methyl ester, MAS: Na-methallyl sulphonate) in aqueous suspension and which had a molecular weight of 210,000 (weight average) and 76,000 (number average), 77.5% of DMF and 0.5% of LiCl was prepared and first heated to 140° C. and then cooled to 90° C. The thus-obtained spinning solution was passed under pressure through a 160-bore spinneret (bore diameter 0.25 mm) at a rate of 246 cc/min. Air heated to 280° C. was blown onto the spun filaments at a rate of 40 $Nm^3/h$. The filaments were taken up at 120 m/min through a duct, the jacket of which had been heated to 160° C. The spun filaments had a total titre of about 4500 dtex and a residual solvent content of about 32% (based on PAN). The spun filaments could be stretched cold by 600% (breaking elongation) and had a tensile strength or 3.7 cN/dtex based on the titre thereof at break.

The filaments were then stretched in steam. FIG. 1 shows how the strength of the stretched filaments, based on the titre thereof, depends upon the stretching ratio and upon the stretching temperature. Thus, the filaments of this Example were found to have a promoted stretching temperature of 117° C. and a promoted stretching ratio $\gamma$ of 16 at which the stretched tow shows maximum strength based on titre (9.1 cN/dtex). The maximum stretching ratio $\gamma_{max}$ of these filaments amounted to 25.

EXAMPLE 4

Production of spun material according to the present invention processed into high-strength fibers by a certain after-treatment at the optimal stretching temperature.

A solution of 24% of the same polymer as in example 3 in 76% of DMF was heated to 140° C. and cooled to 80° C. This solution was passed under pressure through a 72-bore spinneret (bore diameter 0.4 mm) at a rate of 100 cc/min. Air heated to 150° C. was blown onto the spun filaments at 40 $Nm^3/h$. The filaments were taken up through the spinning duct heated to 120° C. at a speed of 135 m/min. These filaments were prestretched cold with a stretching ratio $\gamma_1$ of 3 and further stretched at 117° C. (the optimal temperature for this polymer) in saturated steam with a stretching ratio $\gamma_2$ of 6.7, the total stretching ratio $\gamma$ amounting to 20. The thus obtained filaments had a titre of 1.0 dtex, a titre-based maximum tensile strength of 9.8 cN/dtex and a maximum tensile elongation of 12%. The residual DMF content was below 1%.

EXAMPLE 5

Production of spun material be dry-spinning in known manner

A solution of 29.5% of a copolymer, which had been polymerised from 94% of AN, 5.4% of AME and 0.6% of MAS in aqueous suspension and which had a molecular weight of 170,000 (weight average) and 50,000 (number average), in 70.5% of DMF at 80° C. was heated to 145° C. and passed under pressure through a 1050-bore spinneret (bore diameter 0.25 mm) at a rate of 630 cc/min. Air heated to 350° C. was blown onto the filaments at a rate of 43 $Nm^3/h$. The filaments were taken up at 350 m/min. through a duct heated to 190° C. The filament had a DMF content of 25% and when cold could be stretched by at most 63%. They had a strength of 1.0 cN/dtex, based on the titre thereof at break, and could be stretched in boiling water in a maximum ratio $\gamma_{max}$ of 7. The maximally-stretched filaments had a strength based on the initial titre thereof of 4 cN/dtex and a maximum tensile elongation of about 10%.

EXAMPLE 6

Production of normal spun material by dry spinning in known manner and various after-treatments for obtaining high-strength fibers.

A solution prepared at 90° C. of 24.5% of the same polymer as in Example 1 in 75.5% of DMF was heated to 100° C. and passed under pressure through 280-bore spinnerets (bore diameter 0.15 mm) at a rate of 336 cc/min. Air heated to 400° C. was blown onto the spun filaments at 40 $Nm^3/h$. The filaments were taken up through a duct heated to 190° C. at a rate of 330 m/min.

They had a DMF-content of 35%. Several of these tows which had an overall denier of 0.37 ktex were combined to give a tow having a total thickness of about 25 ktex (for an individual denier of about 12 dtex). The thus-formed tow was subjected to the following alternative after-treatments:

(a) Single-stage stretching in boiling water at a take up speed of 70 m/min and in an optimal stretching ratio $\gamma$ of 6.2. In this case, the optimal stretching ratio $\gamma$ of 6.2 amounted to 83% of the maximal stretching ratio $\gamma_{max}$ of 7.5. After stretching, the tow was continuously washed in water (to which an antistatic preparation had been added) at 90° C. with 12% permitted shrinkage (≙71% of the maximum possible shrinkage of 17%). In the following drying process, the tow was further relaxed in a drum dryer in two dryer sections (by 3% at 105° C. and then by another 2% at 125° C.) and, finally, was wound into package form after leaving the dryer.

(b) Single-stage- stretching in boiling water in a stretching ratio $\gamma$ of 6.6, i.e. above the optimal stretching ratio. Further after-treatment as in (a).

(c) Two-stage stretching generally in accordance with the wet-spinning processes according to JP 53/139824 and DE-OS No. 2,851,273 taking into account the optimal stretching conditions of the process according to the present invention:

In a first stretching stage, the tow was stretched in boiling water in a ratio $\gamma_1$ of 6.2 and then, in a second stretching stage, in excess-pressure saturated steam at an optimal temperature of 125° C. in a ratio $\gamma_2$ of 1.45 (≙85% of $\gamma_{2,max}=1.7$) so that the total stretching ratio $\gamma$ amounted to 9.0. For stretching in steam, the PAN-tow was passed through a steam-filled tube at different entry and exit speeds corresponding to the stretching ratio $\gamma_2$. The tube was provided on both sides with fin-like steam traps to ensure the build-up of excess pressure and to limit the consumption of steam. After stretching, the tow was washed and prepared at a water temperature of 90° C. with a permitted shrinkage of 10% (≙67% of the maximum possible shrinkage of 15%). The tow was allowed to shrink by another 4% during the following low-tension drying process carried out at 120° C. The relaxed stretched tow was finally wound into packages.

(d) Two-stage stretching as in (c), but in a ratio $\gamma_2$ of 1.6, i.e. above the optimal stretching ratio, so that the total stretching ratio $\gamma$ amounted to 9.9. The further after-treatment was carried out in the same way as in (c).

(e) Application of the process according to the present invention:

The tow which began to shrink at 50° C. ($\theta_o \approx 50°$ C.) was continuously shrunk in water at 95° C. by 5%, i.e. the speed at which the tow entered the hydrothermal pretreatment zone was 5% higher than the speed at which it left the zone. The relaxed tow was then continuously stretched in a ratio $\gamma_1$ of 5.0 (≙61% of $\gamma_{1,max}=8.2$) in boiling water, then further stretched in a ratio $\gamma_2$ of 1.8 ( 69% of $\gamma_{2,max}=2.6$) in saturated steam at 115° C. and, finally, was stretched in the optimal stretching ratio $\gamma_3$ of 1.4 (≙ 82% of $\gamma_{3,max}=1.7$) in saturated steam at the optimal temperature of 128° C. so that the total stretching ratio amounted to $\gamma=12.6$. Stretching in steam was carried out in tubes with steam traps on both sides. During the following relaxation and drying process, the stretched tow was partially shrunk by 5% (≙67% of the maximum possible shrinkage of 7.5%) in water at 90° C. (to which an antistatic preparation had been added) and then shrunk by another 2.5% during the drying process carried out in recirculating air at 170° C.

(f) Application of the process according to the present invention:

The tow ($\theta_o \approx 50°$ C.) was shrunk by 9% by continuous passage through water at 95° C. and was then passed through a steam-treatment tube filled with a mixture of steam and air at 125° C. No further shrinkage occurred. After this hydrothermal pre-treatment, the tow was stretched in boiling water in a ratio $\gamma_1$ of 5.0 (≙57% of $\gamma_{1,max}=8.8$) and then in the optimal ratio $\gamma_2$ of 2.85 (≙92% of $\gamma_{2,max}=3.1$) in saturated steam at the optimal temperature of 130° C. so that the total stretching ratio $\gamma$ amounted to 14.3. Stretching in steam was carried out in a tube provided with steam traps on both sides. In the following relaxation and drying process, the stretched tow was partially shrunk by 4% (≙57% of the maximum possible shrinkage of 7%) in water at 90° C. (to which an antistatic preparation had been added) and then shrunk by another 2% at 170° C. in a drum dryer.

(g) Application of the process according to the present invention:

The tow was hydrothermally pretreated in the same way as in (f) and then subjected to two-stage stretching in saturated steam. In the 1st stretching tube, the steam had a temperature of 103° C. and the stretching ratio $\gamma_1$ amounted to 7.0 (≙75% of $\gamma_{1,max}=9.3$). In the second stretching tube, stretching was carried out at the optimal steam temperature of 132° C. and in the optimal stretching ratio $\gamma_2$ of 2.2 (≙94% of $\gamma_{2,max}=2.35$). Thereafter, the total stretching ratio amounted to $\gamma=15.4$. In the following relaxation and drying process, the stretched tow was treated in the same way as in (f).

The stretched tows produced in accordance with Examples 6 (a)–(g) were tested both in unrelaxed form (sampling after stretching) and in the relaxed final state thereof to determine the quality of the tow (by visual inspection) and the textile properties of the individual fibers and to measure boiling-induced shrinkage and the initial modulus of the tow as a whole.

The results set out in Table 1 show that the application of the process according to the present invention (Examples 6 (e), (f), (g)) leads by virtue of the greater stretchability of the spun material to improvements in the quality of the stretched tow, i.e. higher individual-fibre tensile strength, higher initial modulus and lower boiling-induced shrinkage of the unrelaxed tow.

TABLE 1

| | | Unrelaxed stretched tow | | | Relaxed stretched tow | | | |
|---|---|---|---|---|---|---|---|---|
| Examples 6 | Total stretching ratio $\gamma$ | Tow values BS M | Individual fiber values T IT | Individual fiber values E F | Tow values BS M | Individual fiber values T IT | Individual fiber values E F | Visual tow quality |
| a | 6.2 | 20.5 | 9.8 | 12.3 | 1.3 | 10.0 | 19.0 | OK |
| | | 85 | 1.95 | 5.03 | 79 | 2.33 | 4.29 | |
| b | 6.6 | 20.8 | 9.9 | 12.1 | 1.5 | 9.8 | 18.1 | SN |
| | | 92 | 1.86 | 5.32 | 82 | 2.21 | 4.43 | |
| c | 9.0 | 15.3 | 8.0 | 11.5 | 1.4 | 8.3 | 16.5 | OK |
| | | 99 | 1.36 | 5.88 | 88 | 1.55 | 5.35 | |
| d | 9.9 | 16.0 | 7.9 | 11.2 | 1.5 | 8.1 | 15.8 | SN |
| | | 1.2 | 1.33 | 5.94 | 91 | 1.53 | 5.29 | |
| e | 12.6 | 8.8 | 7.1 | 10.5 | 1.5 | 6.9 | 13.2 | OK |
| | | 125 | 0,98 | 7.24 | 100 | 1.11 | 6.22 | |
| f | 14.3 | 7.5 | 6.6 | 9.8 | 1.3 | 6.3 | 12.5 | OK |
| | | 130 | 0,90 | 7.33 | 105 | 0,96 | 6.56 | |
| g | 15.4 | 6.8 | 6.3 | 9.2 | 1.4 | 6.1 | 11.8 | OK |

TABLE 1-continued

| Examples 6 | Total stretching ratio γ | Unrelaxed stretched tow: Tow values BS M | Unrelaxed stretched tow: Individual fiber values T IT | Unrelaxed stretched tow: Individual fiber values E F | Relaxed stretched tow: Tow values BS M | Relaxed stretched tow: Individual fiber values T IT | Relaxed stretched tow: Individual fiber values E F | Visual tow quality |
|---|---|---|---|---|---|---|---|---|
| | | 138 | 0,83 | 7.59 | 109 | 0.89 | 6.85 | |

Abbreviations
BS = boiling-induced shrinkage (%),
M = initial modulus [cN/dtex],
T = tensile strength [cN],
IT = individual initial titre [dtex],
E = breaking elongation (%),
F = tensile strength (based on the initial titre) [cN/dtex];
OK = satisfactory;
SN = snarls

We claim:

1. A process for the production of high-strength filaments of polyacrylonitrile by dry-spinning, comprising (a) producing a spun material at take-up speeds of from 500 to 200 m/min. from acrylonitrile polymers having a molecular weight of more than 170,000 (weight average) and 50,000 (number average) using spinning solutions in which supermolecular structures in the solution characterized by reduced viscosity for the same polymer content, the same temperature and the same molecular weight are degraded by the following methods individually or collectively:

(i) tempering the spinning solution for at least 5 minutes at temperatures above 120° C., (ii) using polymer contents in the solution such that the solution has a dynamic viscosity at 120° C. of less than 40 Pas, (iii) introducing additives having a viscosity-reducing effect, or to produce tension-reduced spun filaments producing a spun material from a tow produced at normal take-up speeds of from 200 to 400 m/min. and subsequently subjecting said material to a hydrothermal treatment at temperatures $\theta=\theta_o$ with $\theta_{O,S}<\theta_o\leqq\theta_n+50°$ C. and to produce tension-reduced spun filaments, (b) stretching the tension-reduced spun filaments continuously hydrothermally in one or more stages such that where it involves several stages, stretching at a temperature of the stretching medium gradually increasing from stage to stage of up to $\theta=\theta_n$ and, in the final (n-th) stage, to a degree of at least 50% of the maximum degree of stretching; where it involves a single stage, stretching at the optimal stretching temperature $\theta_n$ and treating the material thereafter in a conventional way.

2. A process as claimed in claim 1, wherein said tension-reduced spun filaments are stretched 12 to 30 times their original length.

3. A process as claimed in claim 1, wherein the polyacrylonitrile is a copolymer containing at least 50% of acrylonitrile and one or more ethylenically unsaturated monomers copolymerizable therewith.

4. A process as claimed in claim 1, wherein said additive is LiCl.

5. A process as claimed in claim 1, wherein the stretched material is fixed to a predetermined extent.

6. A process as claimed in claim 1, comprising producing the spun material in (a) at a take-up speed of from 80 to 160 m/min. from an acrylonitrile polymer having a molecular weight of more than 190,000 (weight average).

7. A process as claimed in claim 1, comprising the temperature $\theta_o$ at which the spun material in (b) is hydrothermally treated being in the range $\theta_{O,S}+20°<\theta_o<\theta_n+20°$ C.

8. A process as claimed in claim 1, comprising treating the spun material in (b) in parallel and/or with a permitted shrinkage of up to 95%, generally up to 80%, of the maximum possible shrinkage.

9. A process as claimed in claim 1, comprising adjusting stretching at the optimal temperature $\theta_n$ in the final stretching stage (n-th stretching stage), to from 70 to 95% of the maximum partial stretching ratio or, where stretching is carried out in a single stage, to the maximum total stretching ratio and using water, steam/air mixtures and in particular excess-pressure saturated steam at temperatures above 100° C. as the medium for hydrothermal stretching.

10. A process as claimed in claim 1, comprising a total stretching ratio of at least 8:1.

* * * * *